US006729155B1

(12) United States Patent
Chen

(10) Patent No.: US 6,729,155 B1
(45) Date of Patent: May 4, 2004

(54) REFRIGERATING AND HEATING DEVICE

(76) Inventor: Chin-Liang Chen, 9F-4, No. 91, Yunghsing Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/452,197

(22) Filed: Jun. 3, 2003

(51) Int. Cl.[7] ..... F25B 13/00
(52) U.S. Cl. ..... 62/324.1; 62/324.6
(58) Field of Search ..... 62/324.1, 324.3, 62/324.6

(56) References Cited

U.S. PATENT DOCUMENTS 3,308,877 A * 3/1967 Gerteis ..... 165/240
4,862,705 A * 9/1989 Nakamura et al. ..... 62/324.1
5,131,240 A * 7/1992 Kohashi et al. ..... 62/324.1
5,275,008 A * 1/1994 Song et al. ..... 62/81
6,223,549 B1 * 5/2001 Kasai ..... 62/324.1
2004/0000161 A1 * 1/2004 Khelifa et al. ..... 62/324.1

* cited by examiner

*Primary Examiner*—William E. Tapolcai
(74) *Attorney, Agent, or Firm*—Fei-Fei Chao; Venable LLP

(57) ABSTRACT

A refrigerating and heat device has a compressor, a four-way valve, three heat exchangers, a switching component, and a plurality of pipes connecting these elements. The refrigerating and heating device can be used in multiple modes including at least a cold-hot synchronous mode, a hot mode, a cold mode or an ice-storing mode.

29 Claims, 15 Drawing Sheets

REFRIGERATING AND HEATING DEVICE

BACKGROUND OF THE INVENTION

1. Field of the Invention

The present invention is related to a device which can be selectively operated in multiple modes, such as a cold-hot synchronous mode, a hot mode, a cold mode or an ice-storing mode.

2. Description of Related Art

Conventional air conditioners will generate a lot of hot air discharged into the external environment during operating in a cold mode. For the sake of saving energy, some air conditioners are provided with a heat recycle means for using waste heat to supply hot water during operating in the cold mode.

However, these air conditioners can only use waste heat in the cold mode, and will still waste a lot of cold during operating in a hot mode.

Therefore, the invention provides a refrigerating and heating device to mitigate and/or obviate the aforementioned problems.

SUMMARY OF THE INVENTION

The main objective of the invention is to provide a refrigerating and heating device which can be selectively operated in multiple modes including a cold-hot synchronous mode, a hot mode, a cold mode or an ice-storing mode.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
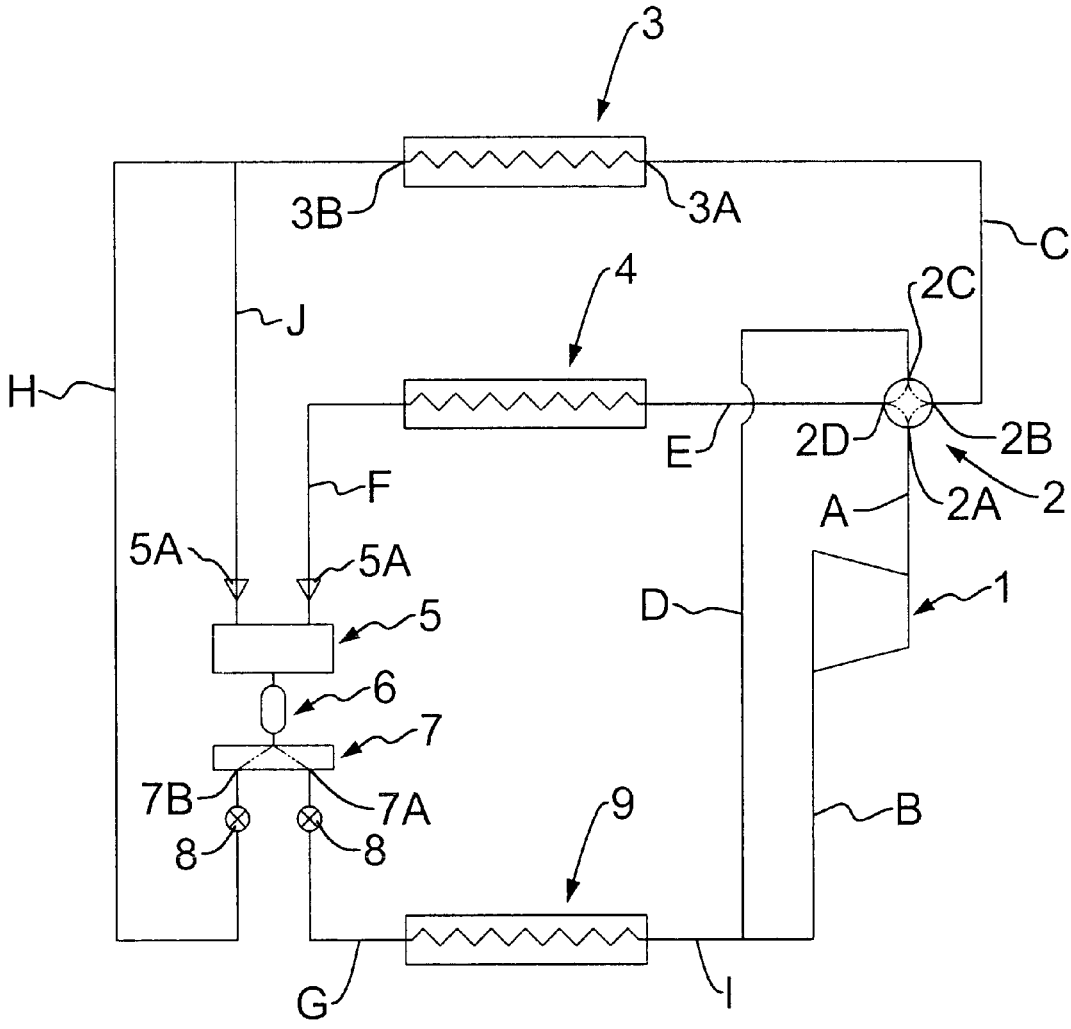
FIG. 1 is a schematic view of a refrigerating and heating device in accordance with the invention.

Referring to FIG. 1, a refrigerating and heating device in accordance with the invention includes a compressor (1), a four-way valve (2), a first heat exchanger (3), a second heat exchanger (4), a two-way switching means (7), a third heat exchanger (9), and a plurality of pipes connecting these elements.

An output end of the compressor (1) is connected with a first end (2A) of the four-way valve (2) by a first pipe (A). The compressor (1) is further provided with a second pipe (B) at an input end thereof. A second end (2B) of the fourway valve (2) is connected with a first input/output end (3A) of the first heat exchanger (3) by a third pipe (C), a third end (2C) of the four-way valve (2) is provided with a fourth pipe (D) connected with the second pipe (B), and a fourth end (2D) of the four-way valve (2) is connected with an input end of the second heat exchanger (4) by a fifth pipe (E).

An output end of the second heat exchanger (4) is connected with an output end of the switching means (7) by a sixth pipe (F). The switching means (7) has a first outlet (7A) connected with an input end of the third heat exchanger (9) by a seventh pipe (G), and a second outlet (7B) connected with a second input/output end (3B) of the first heat exchanger (3) by an eighth pipe (H). An output end of the third heat exchanger (9) is provided with a ninth pipe (I) connected with the second pipe (B). A tenth pipe (J) is connected between the eighth pipe (H) and another input end of the switching means (7).

Figure 2:
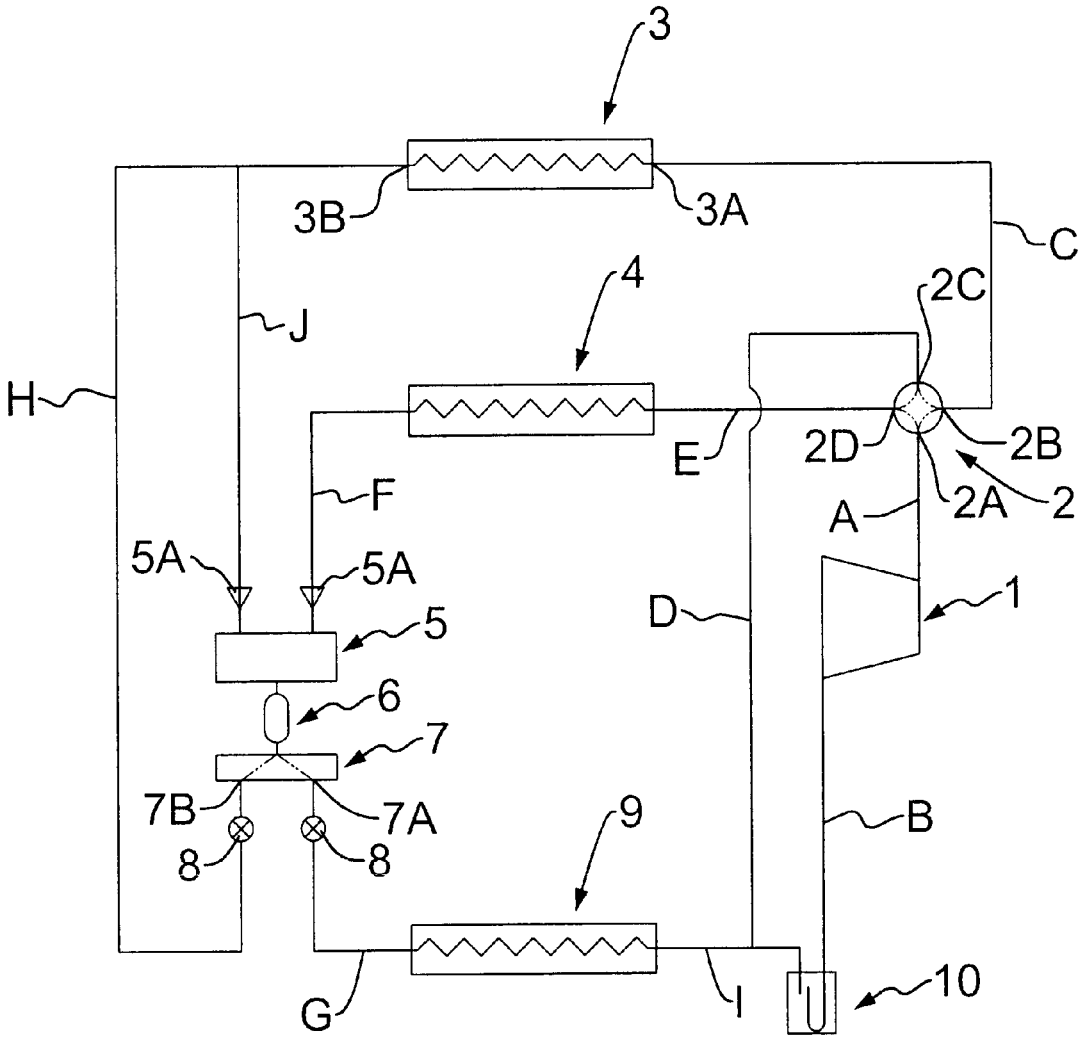
FIG. 2 is a schematic view of the refrigerating and heating device in FIG. 1 with a liquid-gas separator added.

Referring to FIG. 2, the device further has a liquid-gas separator (10) provided between the ninth pipe (I) and the second pipe (B).

Figure 3:
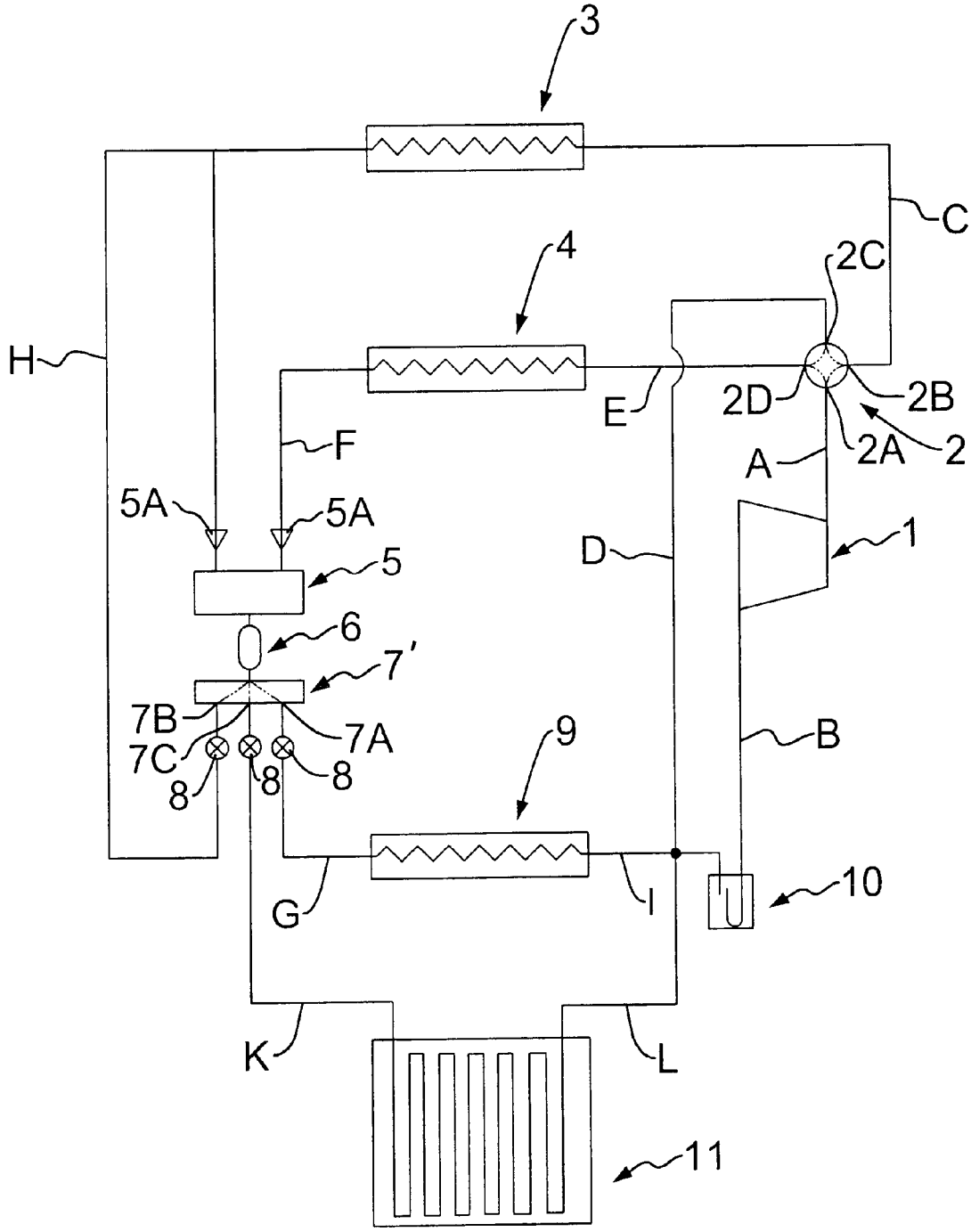
FIG. 3 is a schematic view of the refrigerating and heating device in FIG. 2 with an ice compartment added.

Referring to FIG. 3, the device is further provided with an ice chamber (11). The two-way switching means (7) is replaced with a three-way switching means (7'). The ice chamber (11) has an input end connected with a third outlet (7C) by an eleventh pipe (K), and an output end connected with the liquid-gas separator (10) by a twelfth pipe (L).

Referring to FIGS. 1–3, the sixth pipe (E) and the tenth pipe (J) are first connected with a liquid chamber (5) before the switching means (7). Two check valves (5A) are respectively provided in the sixth pipe (E) and the tenth pipe (J) for preventing refrigerant from flowing back from the switching means (7). Another check valve (not shown or numbered) is provided in the fifth pipe (E) for preventing the refrigerant from flowing back from the second heat exchanger (4).

The device further has a dryer (6) provided between the liquid chamber (5) and the switching means (7). Two (three in FIG. 3) expanding members (8) are respectively provided at the outlets of the switching means (7).

In operation, the device illustrated in FIG. 2 can be functioned in the following modes:

1. Cold-hot synchronous mode

Figure 4:
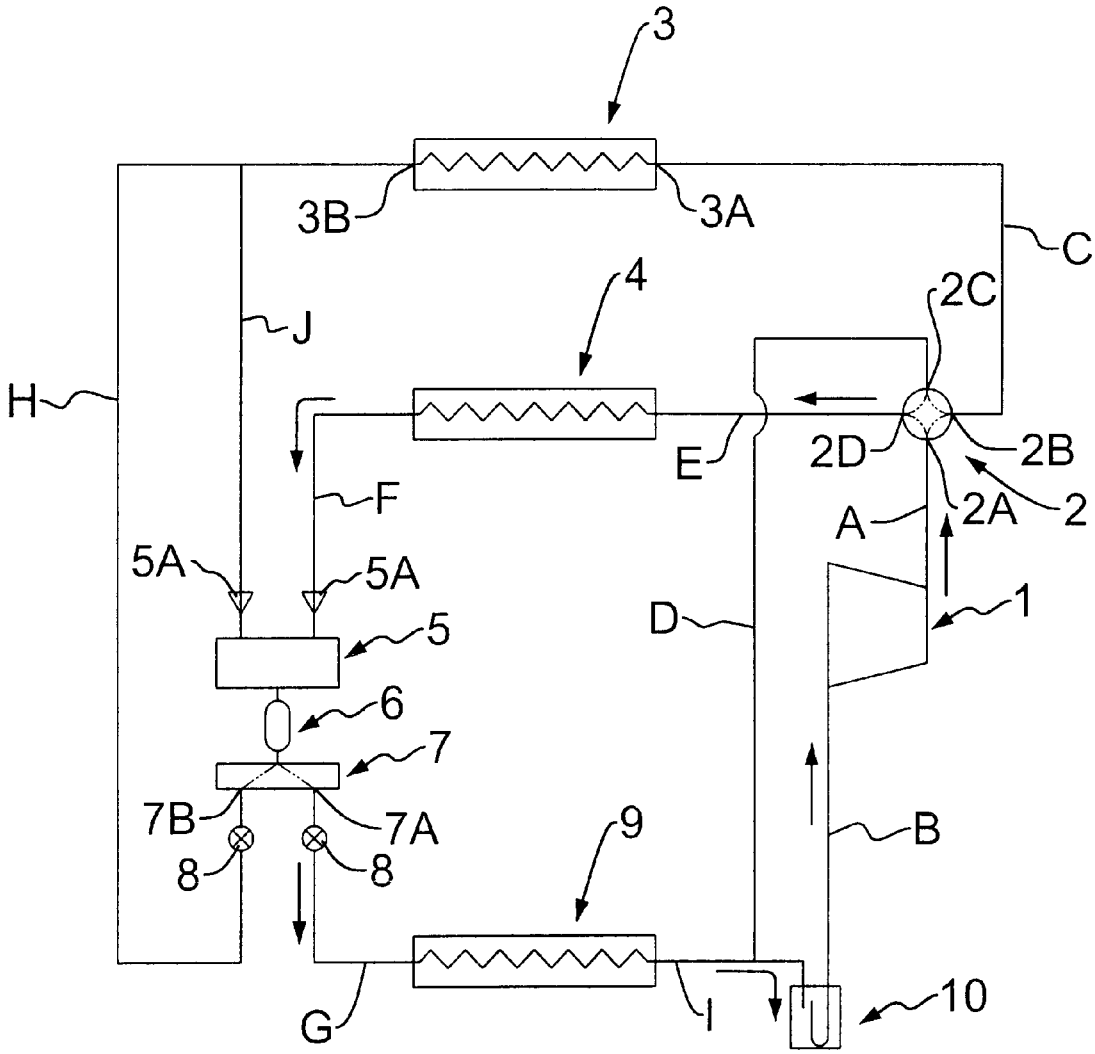
FIG. 4 is a schematic view of the refrigerating and heating device in FIG. 2 operated in the first mode.

Referring to FIG. 4, the four-way valve (2) is in a status of the first end (2A) in communication with the fourth end (2D) and the second end (2B) in communication with the third end (2C), and the first outlet (7A) of the switching means (7) is open. The gaseous refrigerant flowing from the liquid-gas separator (10) through the second pipe (B) is compressed by the compressor (1) and transforms to a liquid state to flow through the first pipe (A), the four-way valve (2), the fifth pipe (E) and into the second heat exchanger (4). The compressed refrigerant in the second heat exchanger (4) will emit considerable heat. A fan (not shown or numbered) can be provided beside the second heat exchanger (4) for blowing out hot air. Alternatively, driven by a pump, water can flow through the second heat exchanger (4) and be heated for supplying hot water.

Thereafter, the refrigerant flows through the sixth pipe (F), the liquid chamber (5), the dryer (6), the first outlet (7A) of the switching means (7), the expanding member (8), the seventh pipe (G), and into the third heat exchanger (9). In the third heat exchanger (9), the expanded refrigerant transforms to a gaseous state to absorb a lot of heat, and another fan (not shown or numbered) can be provided beside the third heat exchanger (9) for blowing out cold air. Alternatively, driven by a pump, water can flow through the third heat exchanger (9) and be cooled for supplying cold water.

Thereafter, the refrigerant flows out from the third exchanger (9) and through the ninth pipe (I) into the gas-liquid separator (10) to separate gaseous refrigerant for the next cycle. In this process, the device can supply hot and cold air (or water) at the same time.

2. Hot mode

Figure 5:
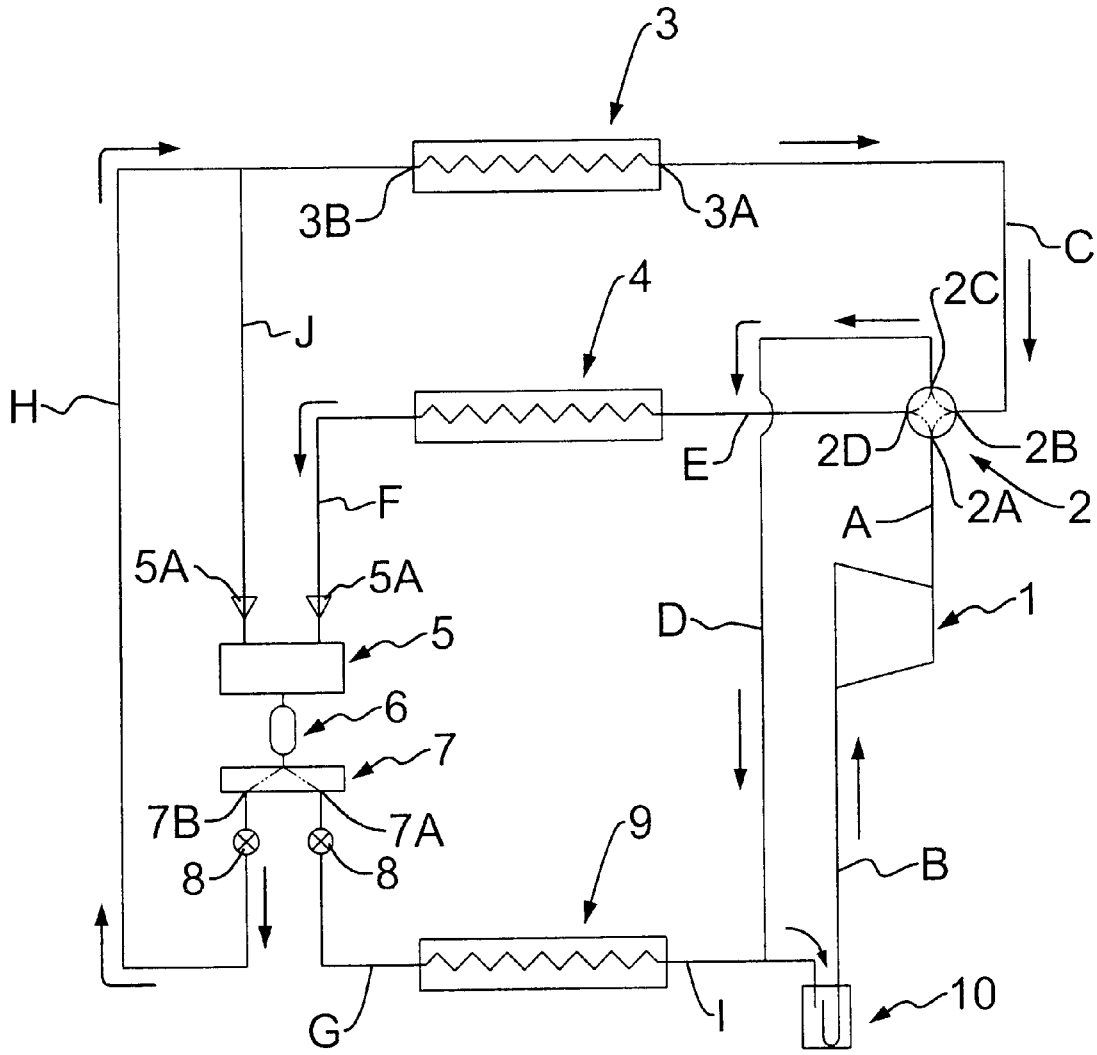
FIG. 5 is a schematic view of the refrigerating and heating device in FIG. 2 operated in the second mode.

Referring to FIG. 5, the four-way valve (2) is in a status of the first end (2A) in communication with the fourth end (2D) and the second end (2B) in communication with the third end (2C), and the second outlet (7B) of the switching means (7) is open. The gaseous refrigerant flowing from the liquid-gas separator (10) through the second pipe (B) is compressed by the compressor (1) and transforms to a liquid state to flow through the first pipe (A), the four-way valve (2), the fifth pipe (E) and into the second heat exchanger (4). The compressed refrigerant in the second heat exchanger (4) will emit considerable heat for supplying hot air or water.

Thereafter, the refrigerant flows through the sixth pipe (F), the liquid chamber (5), the dryer (6), the first outlet (7B) of the switching means (7), the expanding member (8), the eighth pipe (H), and into the first heat exchanger (3). In the first heat exchanger (3), the expanded refrigerant transforms to a gaseous state to exchange heat with the external environment.

Thereafter, the refrigerant flows out from the first exchanger (3) and into the gas-liquid separator (10) through the third pipe (C), the four-way valve (2), and the fourth pipe (D). In this process, the device only supplies hot air (or water) generated by the second heat exchanger (4).

3. Cold mode

Figure 6:
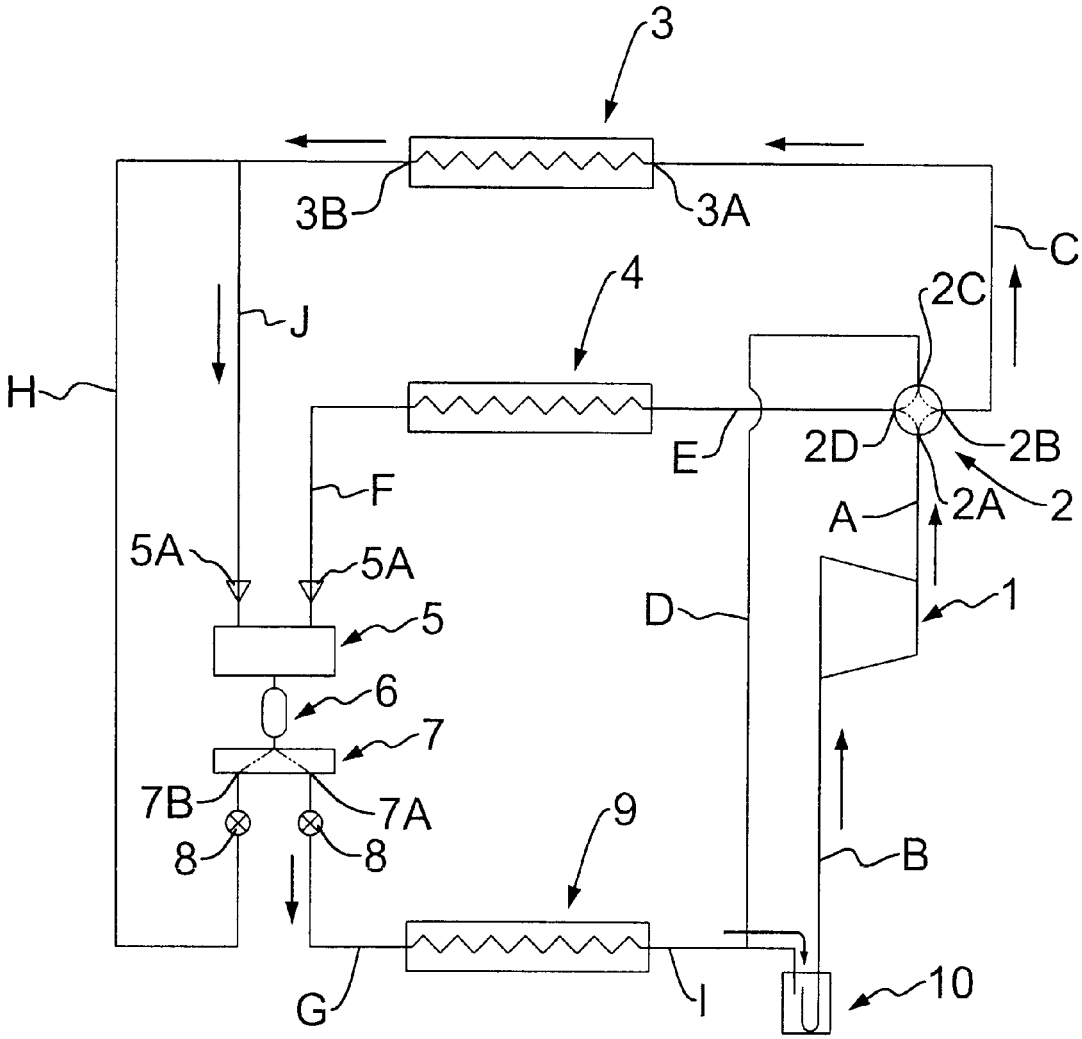
FIG. 6 is a schematic view of the refrigerating and heating device in FIG. 2 operated in the third mode.

Referring to FIG. 6, the four-way valve (2) is in a status of the first end (2A) in communication with the second end (2B) and the third end (2C) in communication with the fourth end (2D), and the first outlet (7A) of the switching means (7) is open. The gaseous refrigerant flowing from the liquid-gas seperator (10) through the second pipe (B) is compressed by the compressor (1) and transforms to a liquid state to flow through the first pipe (A), the four-way valve (2), the third pipe (C) and into the first heat exchanger (3). In the first heat exchanger (3), the compressed refrigerant exchanges heat with the external environment.

Thereafter, the refrigerant flows through the tenth pipe (J), the liquid chamber (5), the dryer (6), the first outlet (7A) of the switching means (7), the expanding member (8), the seventh pipe (G), and into the third heat exchanger (9). In the third heat exchanger (9), the expanded refrigerant transforms to a gaseous state to absorb a lot of heat for supplying cold air or water.

Thereafter, the refrigerant flows out from the third exchanger (9) and through the ninth pipe (I) into the gas-liquid separator (10) for the next cycle. In this process, the device only supplies cold air (or water) generated by the third heat exchanger (9).

Figure 7:
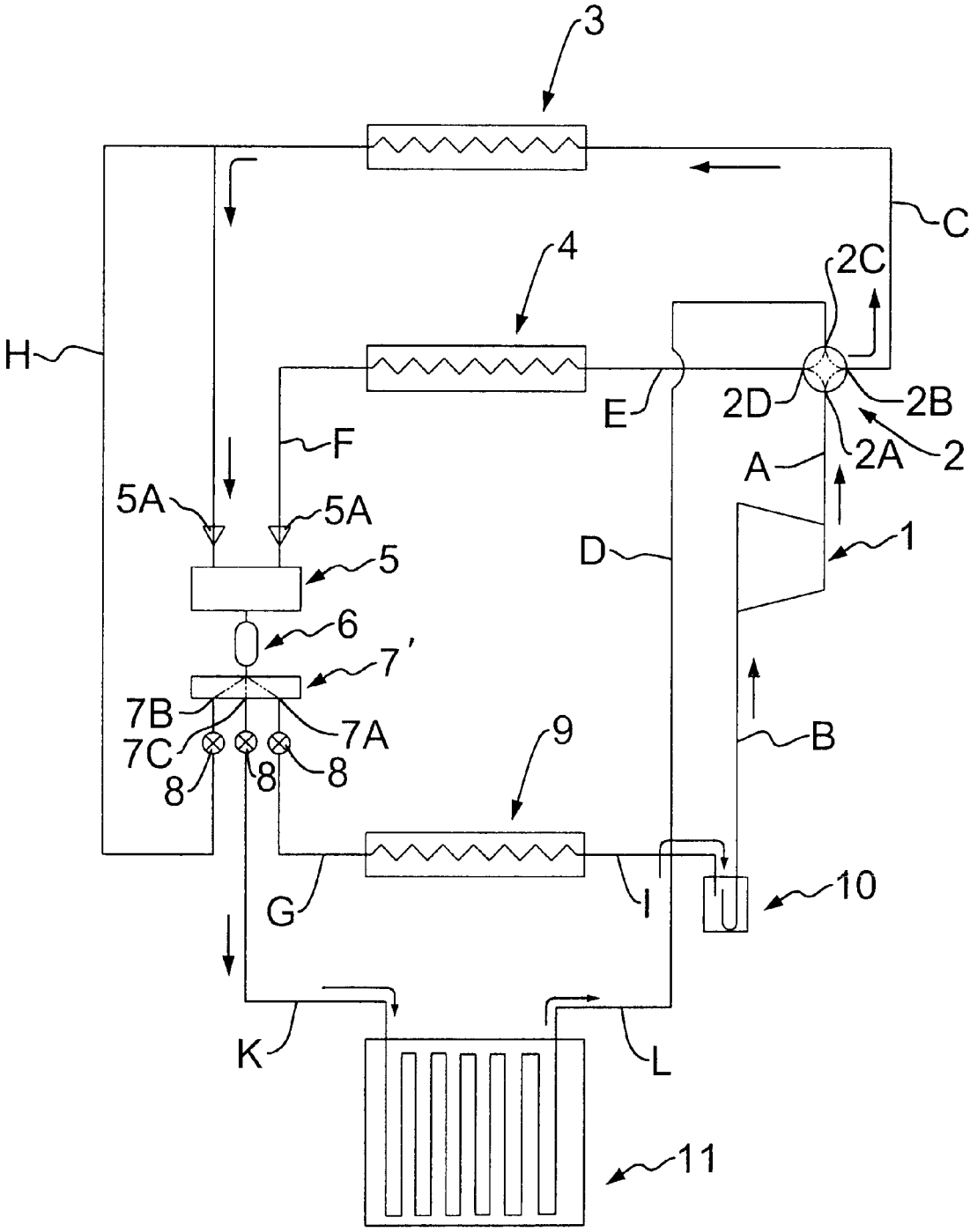
FIG. 7 is a schematic view of the refrigerating and heating device in FIG. 3 operated in the fourth mode.

Referring to FIG. 7, beside the three modes as described above, the embodiment shown in FIG. 3 further has an ice-storing mode. In this mode, the four-way valve (2) is in a status of the first end (2A) in communication with the second end (2B) and the third end (2C) in communication with the fourth end (2D), and the third outlet (7C) of the switching means (7') is open.

The gaseous refrigerant flows from the liquid-gas separator (10) through the second pipe (B) is compressed by the compressor (1) and transforms to a liquid state to flow through the first pipe (A), the four-way valve (2), the third pipe (C) and into the first heat exchanger (3) to exchange heat with the external environment.

Thereafter, the refrigerant flows through the tenth pipe (J), the liquid chamber (5), the dryer (6), the third outlet (7C) of the switching means (7'), the expanding member (8), the eleventh pipe (K), and into the ice chamber (11) to absorb a lot of heat for retaining a low temperature to enable storage of ice in the ice chamber (11).

Thereafter, the refrigerant flows out from the ice chamber (11) and through the twelfth pipe (L) into the gas-liquid separator (10) for the next cycle.

Figure 8:
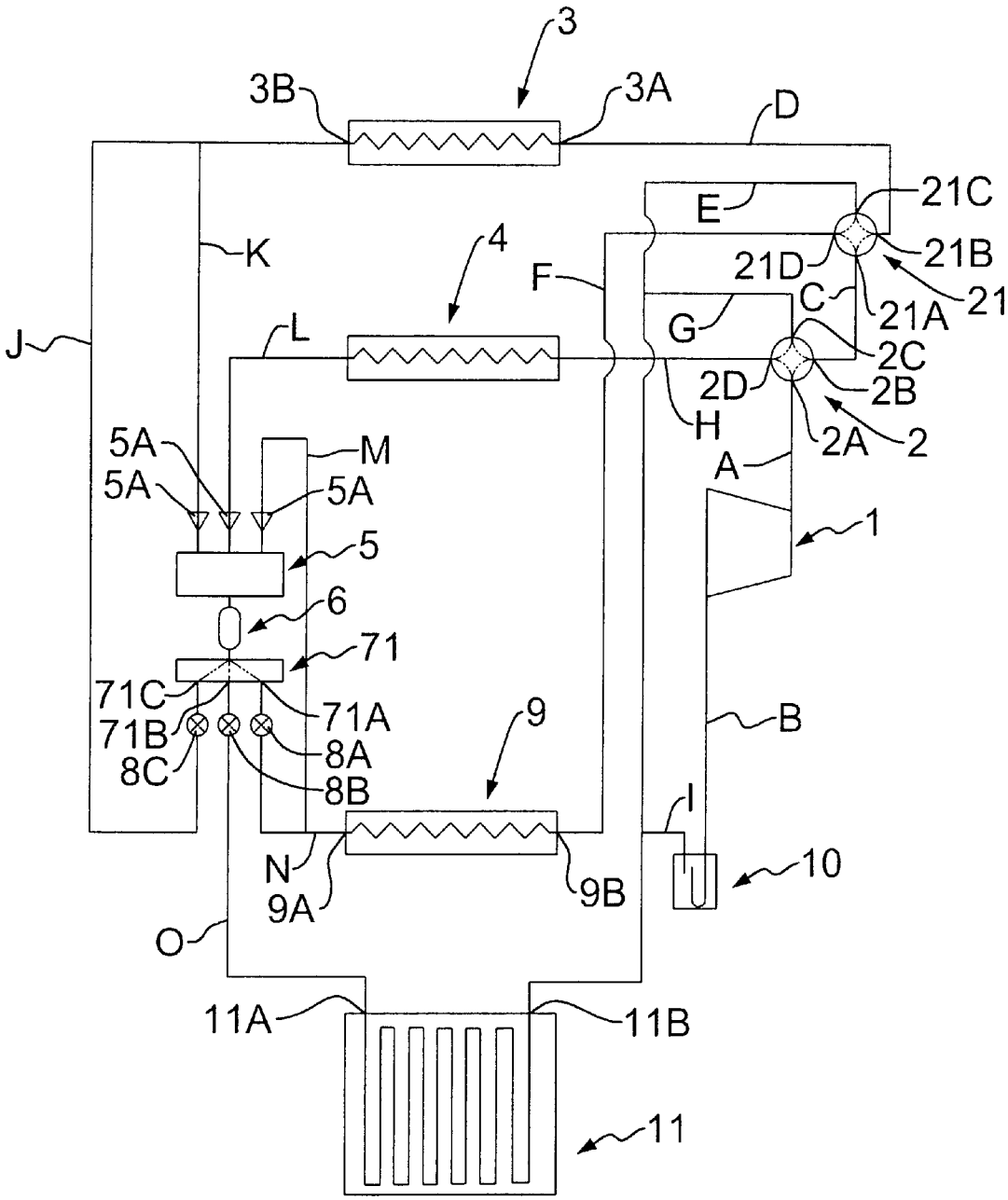
FIG. 8 is a schematic view of another embodiment in accordance with the present invention.

According to the present invention, a further embodiment is illustrated in FIG. 8. The device includes a compressor (1), a first four-way valve (2), a second four-way valve (21), a first heat exchanger (3), a second heat exchanger (4), a liquid chamber (5), a three-way switching means (71), a third heat exchanger (9), a gas-liquid separator (10), an ice chamber (11), and a plurality of pipes connecting these elements.

An output end of the compressor (1) is connected with a first end (2A) of the first four-way valve (2) by a first pipe (A). An input end of the compressor (1) is connected with the gas-liquid separator (10) by a second pipe (B). A second end (2B) of the four-way valve (2) is connected with a first end (21A) of the second four-way valve (21) by a third pipe (C). A second end (21B) of the second four-way valve (21) is connected with a first input/output end (3A) of the first heat exchanger (3) by a fourth pipe (D). A third end (21C) of the second four-way valve (21) is provided with a fifth pipe (E) connected with an input end of the gas-liquid separator (10), and a fourth end (21D) of the second four-way valve (21) is connected with a second input/output end (9B) of the third heat exchanger (9) by a sixth pipe (F). A third end (2C) of the first four-way valve (2) is connected with the fifth pipe (E) by a seventh pipe (G), and a fourth end (2D) of the first four-way valve (2) is connected with an input end of the second heat exchanger (4) by an eighth pipe (H). The fifth pipe (E) is connected with the gas-liquid separator (10) by a ninth pipe (I).

An output end of the second heat exchanger (4) is connected with the liquid chamber (5) by a twelfth pipe (L). A dryer (6) is connected between the liquid chamber (5) and the switching means (71), which has three outlets (71A, 71B, 71C) respectively connected with three expanding members (8A, 8B, 8C). The first outlet (71A) and the first expanding member (8A) are connected with a first input/output end (9A) of the third heat exchanger (9) by a fourteenth pipe (N), the second outlet (71B) and the second expanding member (8B) are connected with an input end (11A) of the ice chamber (11) by a fifteenth pipe (O), and the third outlet (71C) and third expanding member (8C) are connected with a second input/output end (3B) of the first heat exchanger (3) by a tenth pipe (J). An output end (11B) of the ice chamber (11) is connected with the gas-liquid separator (10) by the ninth pipe (I). The tenth pipe (J) is further connected with the liquid chamber (5) by an eleventh pipe (K), and the fourteenth pipe (N) is further connected with the liquid chamber (5) by a thirteenth pipe (M). Three check valves (5A) are respectively provided in the eleventh pipe (11), the twelfth pipe (12), and the thirteenth pipe (M) for preventing refrigerant from flowing back from the switching means (71).

Figure 9:
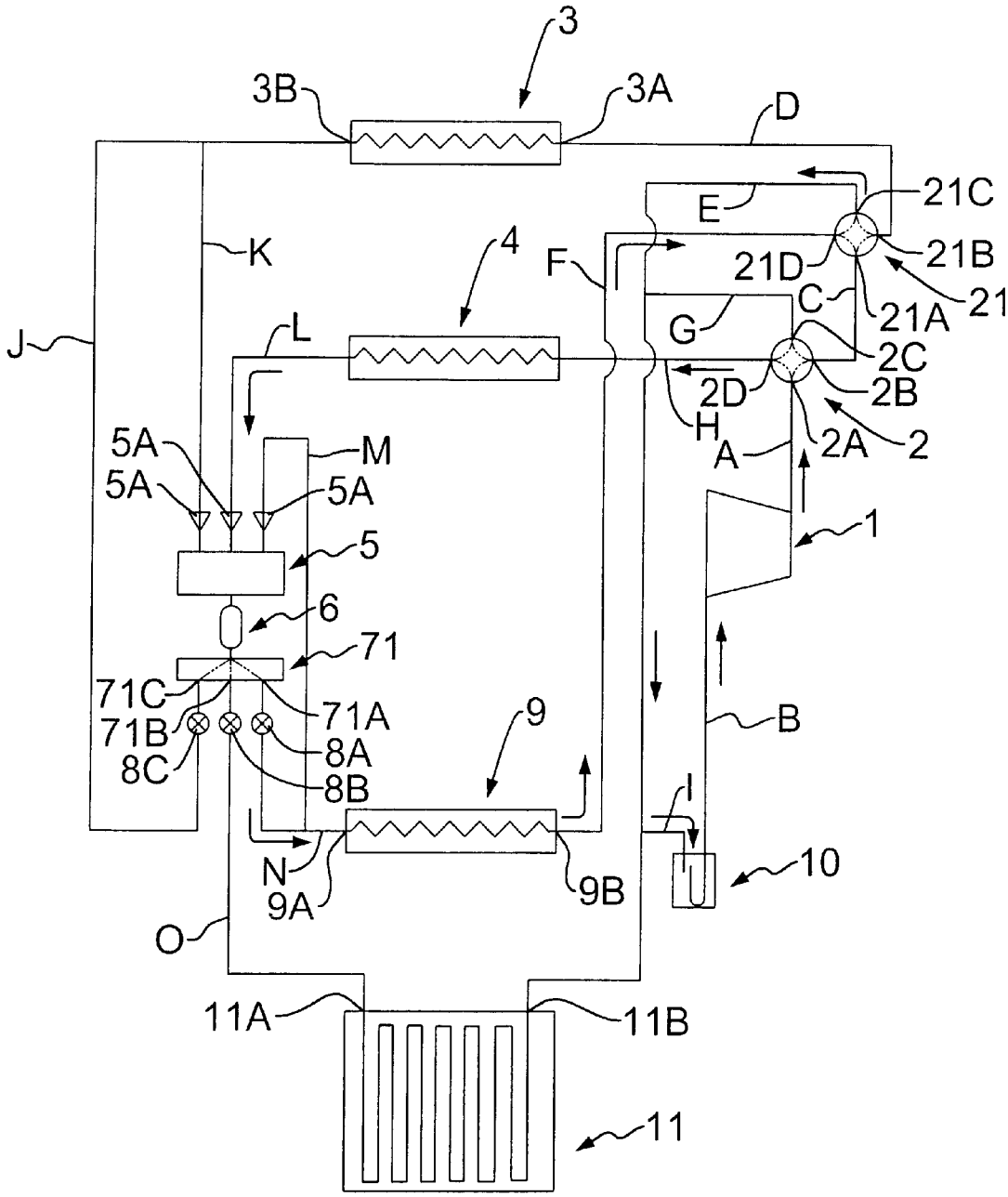
FIG. 9 is a schematic view of the embodiment in FIG. 8 operated in the first mode.

The device illustrated in FIG. 8 can be functioned in the following modes:

1. Cold-hot synchronous mode:

Referring to FIG. 9, the first four-way valve (2) is in a status of the first end (2A) in communication with the fourth end (2D), and the second end (2B) in communication with the third end (2C); the second four-way valve (21) is in a status of the first end (21A) in communication with the second end (21B); and the third end (21C) in communication with the fourth end (21D); and the first outlet (71A) of the switching means (71) is open.

The gaseous refrigerant flowing from the liquid-gas separator (10) through the second pipe (B) is compressed by the compressor (1) and flows through the first pipe (A), the first four-way valve (2), the eighth pipe (H) into the second heat exchanger (4) for supplying hot air (or water).

Thereafter, the refrigerant flows through the twelfth pipe (L), the liquid chamber (5), the dryer (6), the first outlet (71A) of the switching means (71), the first expanding member (8A), the fourteenth pipe (N), and into the third heat exchanger (9) for supplying cold air (or water).

Thereafter, the refrigerant flows out from the third exchanger (9) and through the sixth pipe (F), the second four-way valve (21), the fifth pipe (E), the ninth pipe (I) into the gas-liquid separator (10) to separate gaseous refrigerant for the next cycle. In this process, the device can supply hot and cold air (or water) at the same time.

Figure 10:
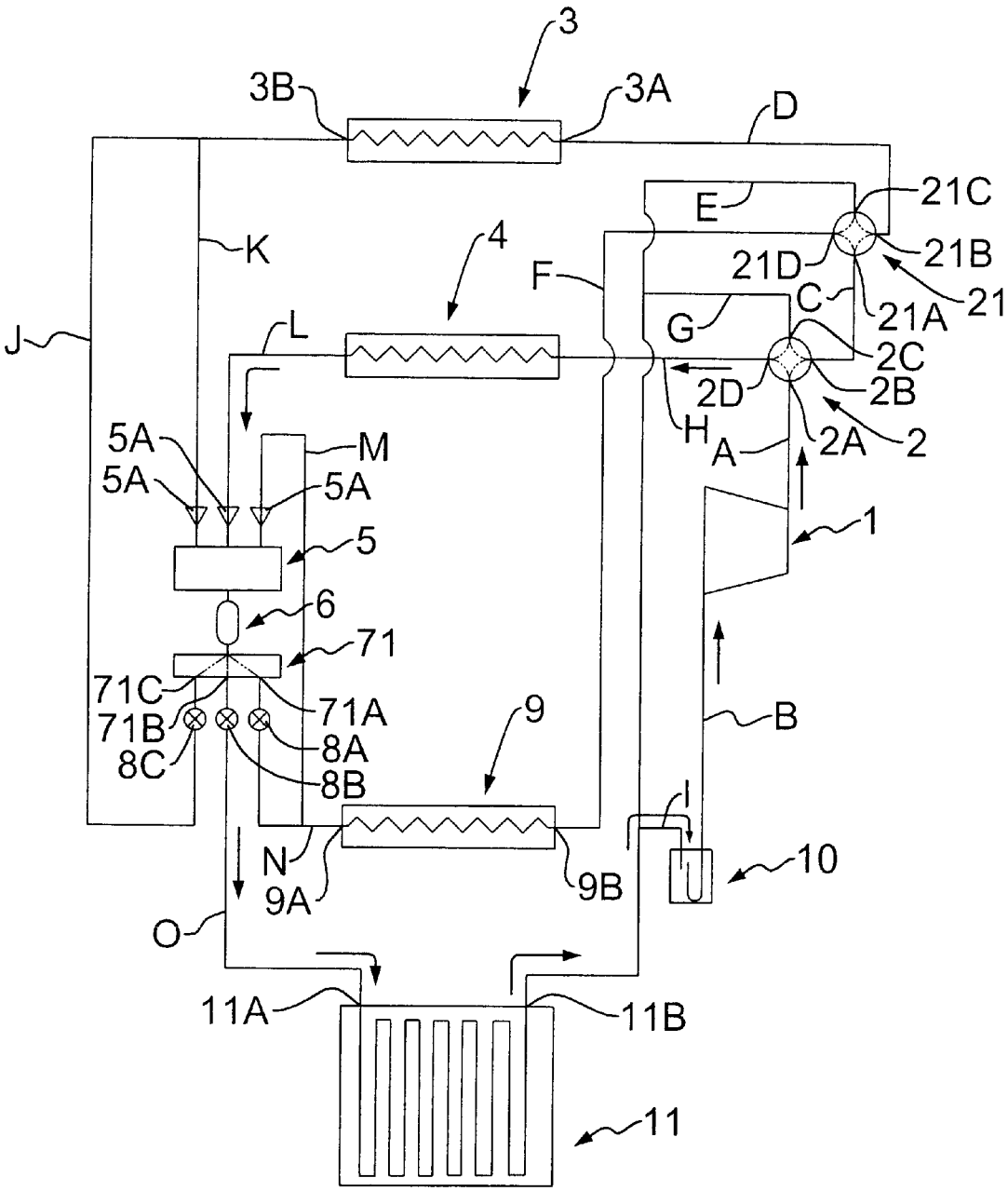
FIG. 10 is a schematic view of the embodiment in FIG. 8 operated in the second mode.

2. Hot and ice-storing synchronous mode:

Referring to FIG. 10, the first four-way valve (2) is in a status of the first end (2A) in communication with the fourth end (2D), and the second end (2B) in communication with the third end (2C); and the third end (21C) in communication with the fourth end (21D); and the second outlet (71B) of the switching means (71) is open.

The gaseous refrigerant flowing from the liquid-gas separator (10) through the second pipe (B) is compressed by the compressor (1) and flows through the first pipe (A), the first four-way valve (2), the eighth pipe (H) and into the second heat exchanger (4) for supplying hot air (or water).

Thereafter, the refrigerant flows through the twelfth pipe (L), the liquid chamber (5), the dryer (6), the second outlet (71B) of the switching means (71), the second expanding member (8B), the fifteenth pipe (0), and into the ice chamber (11) for maintaining a low temperature to enable ice to be stored in the ice chamber (11).

Thereafter, the refrigerant flows out from the ice chamber (11) and through the fifth pipe (E), the ninth pipe (I) and into the gas-liquid separator (10) to separate gaseous refrigerant for the next cycle. In this process, the device can supply hot air (or water) and be used for storing ice at the same time.

3. Hot mode

Figure 11:
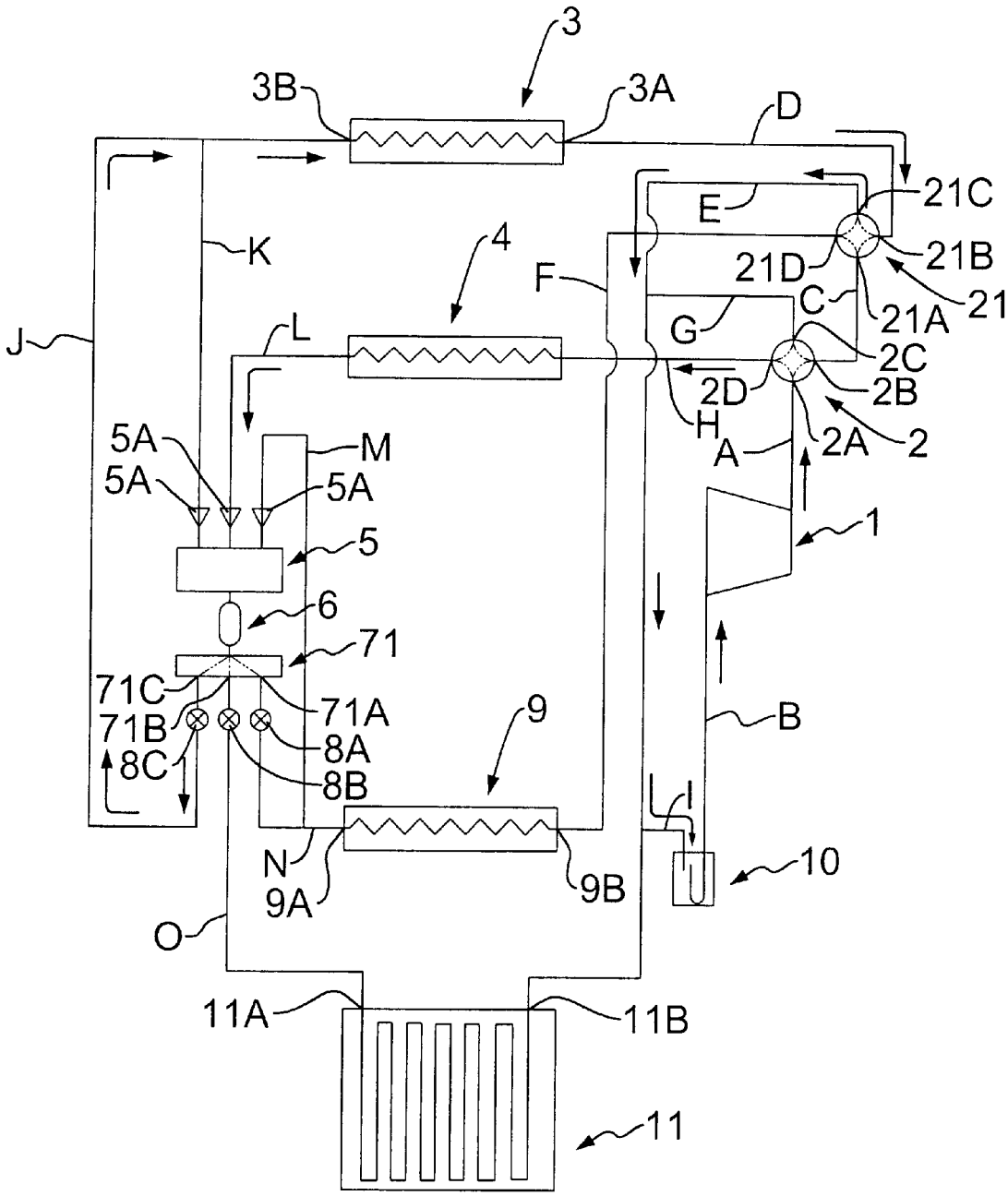
FIG. 11 is a schematic view of the embodiment in FIG. 8 operated in the third mode.

Referring to FIG. 11, the first four-way valve (2) is in a status of the first end (2A) in communication with the fourth end (2D), and the second end (2B) in communication with the third end (2C); the second four-way valve (21) is in a status of the first end (21A) in communication with the fourth end (21D), and the second end (21B) in communication with the third end (21C); and the third outlet (71C) of the switching means (71) is open.

The gaseous refrigerant flowing from the liquid-gas separator (10) through the second pipe (B) is compressed by the compressor (1) and flows through the first pipe (A), the first four-way valve (2), the eighth pipe (H) into the second heat exchanger (4) for supplying hot air (or water).

Thereafter, the refrigerant flows through the twelfth pipe (L), the liquid chamber (5), the dryer (6), the third outlet (71C) of the switching means (71), the third expanding member (8C), the tenth pipe (J), and into the first heat exchanger (3) to exchange heat with the external environment.

Thereafter, the refrigerant flows out from the first exchanger (3) and through the fourth pipe (D), the second four-way valve (21), the fifth pipe (E), the ninth pipe (I) into the gas-liquid separator (10) to separate gaseous refrigerant for the next cycle. In this process, the device can only supply hot air (or water).

Figure 12:
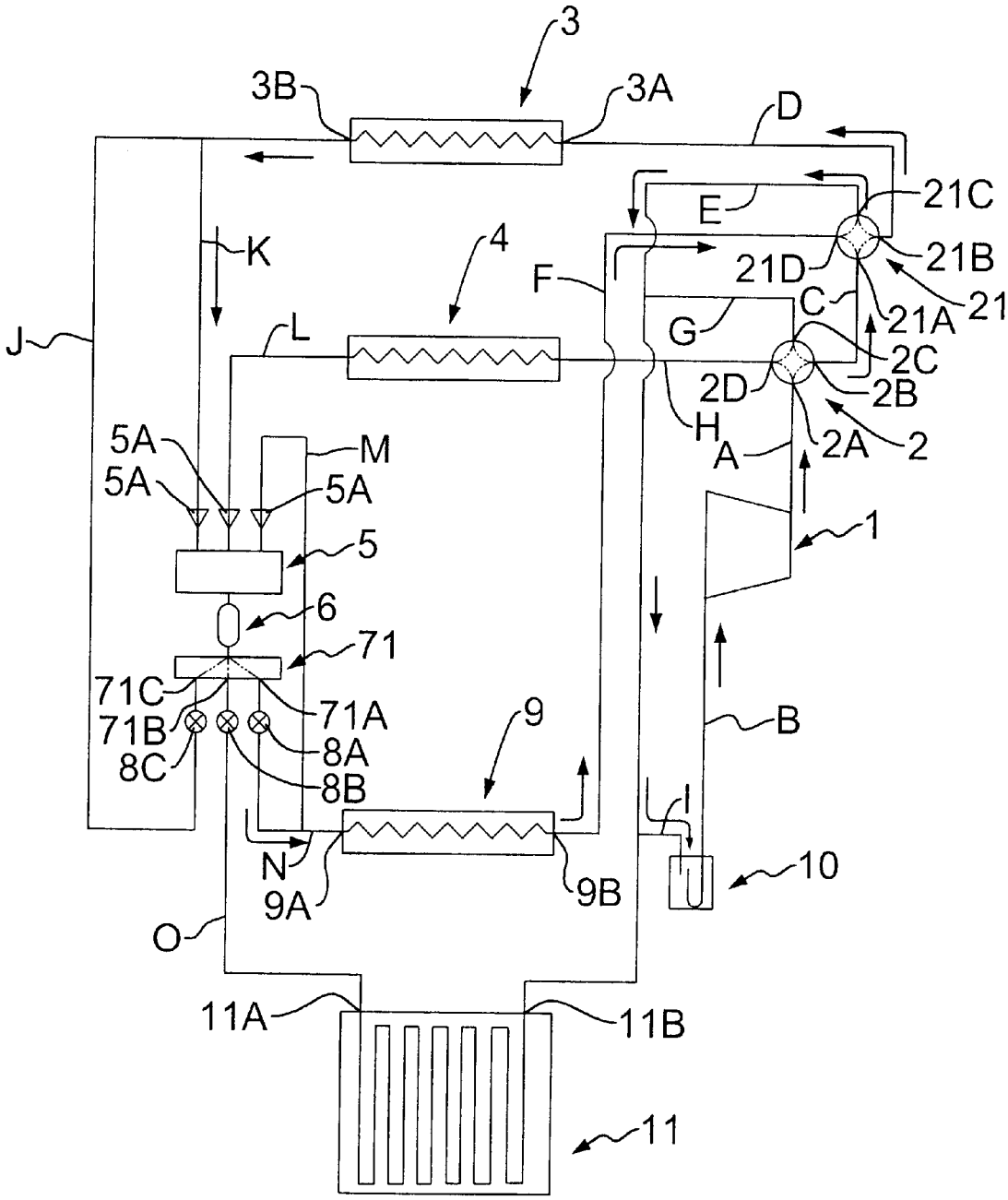
FIG. 12 is a schematic view of the embodiment in FIG. 8 operated in the fourth mode.

4. Cold mode:

Referring to FIG. 12, the first four-way valve (2) is in a status of the first end (2A) in communication with the second end (2B), and the third end (2C) in communication with the fourth end (2D); the second four-way valve (21) is in a status of the first end (21A) in communication with the second end (21B), and the third end (21C) in communication with the fourth end (21D); and the first outlet (71A) of the switching means (71) is open.

The gaseous refrigerant flowing from the liquid-gas separator (10) through the second pipe (B) is compressed by the compressor (1) and flows through the first pipe (A), the first four-way valve (2), the third pipe (C), the second four-way valve (21) into the first heat exchanger (3) to exchange heat with the external environment.

Thereafter, the refrigerant flows through the eleventh pipe (K), the liquid chamber (5), the dryer (6), the first outlet (71A) of the switching means (71), the first expanding member (8A), the fourteenth pipe (N), and into the third heat exchanger (9) for supplying cold air (or water).

Thereafter, the refrigerant flows out from the third exchanger (9) and through the sixth pipe (F), the second four-way valve (21), the fifth pipe (E), the ninth pipe (I) into the gas-liquid separator (10) to separate gaseous refrigerant for the next cycle. In this process, the device can only supply cold air (or water).

Figure 13:
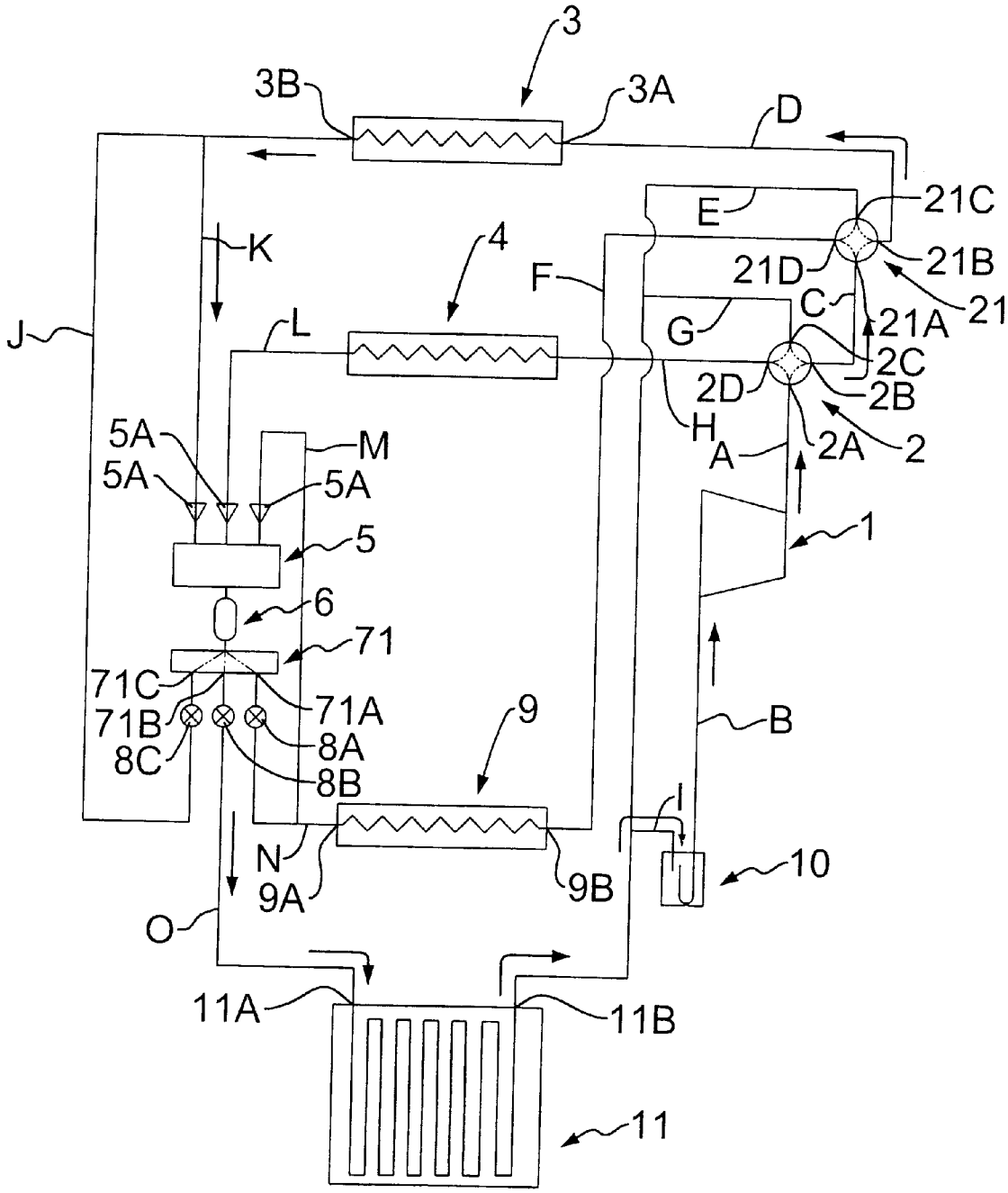
FIG. 13 is a schematic view of the embodiment in FIG. 8 operated in the fifth mode.

5. Ice-storing mode:

Referring to FIG. 13, the first four-way valve (2) is in a status of the first end (2A) in communication with the second end (2B), and the third end (2C) in communication with the fourth end (2D); the second four-way valve (21) is in a status of the first end (21A) in communication with the second end (21B), and the third end (21C) in communication with the fourth end (21D); and the second outlet (71B) of the switching means (71) is open.

The gaseous refrigerant flowing from the liquid-gas separator (10) through the second pipe (B) is compressed by the compressor (1) and flows through the first pipe (A), the first four-way valve (2), the third pipe (C), the second four-way valve (21) and into the first heat exchanger (3) to exchange heat with the external environment.

Thereafter, the refrigerant flows through the eleventh pipe (K), the liquid chamber (5), the dryer (6), the second outlet (71B) of the switching means (71), the second expanding member (8B), the fifteenth pipe (O), and into the ice chamber (11) for maintaining a low temperature to enable storage of ice in the ice chamber (11).

Thereafter, the refrigerant flows out from the ice chamber ( 11) and through the fifth pipe (E), the ninth pipe (I) into the gas-liquid separator (10) to separate gaseous refrigerant for the next cycle. In this process, the device can be used for storing ice.

Figure 14:
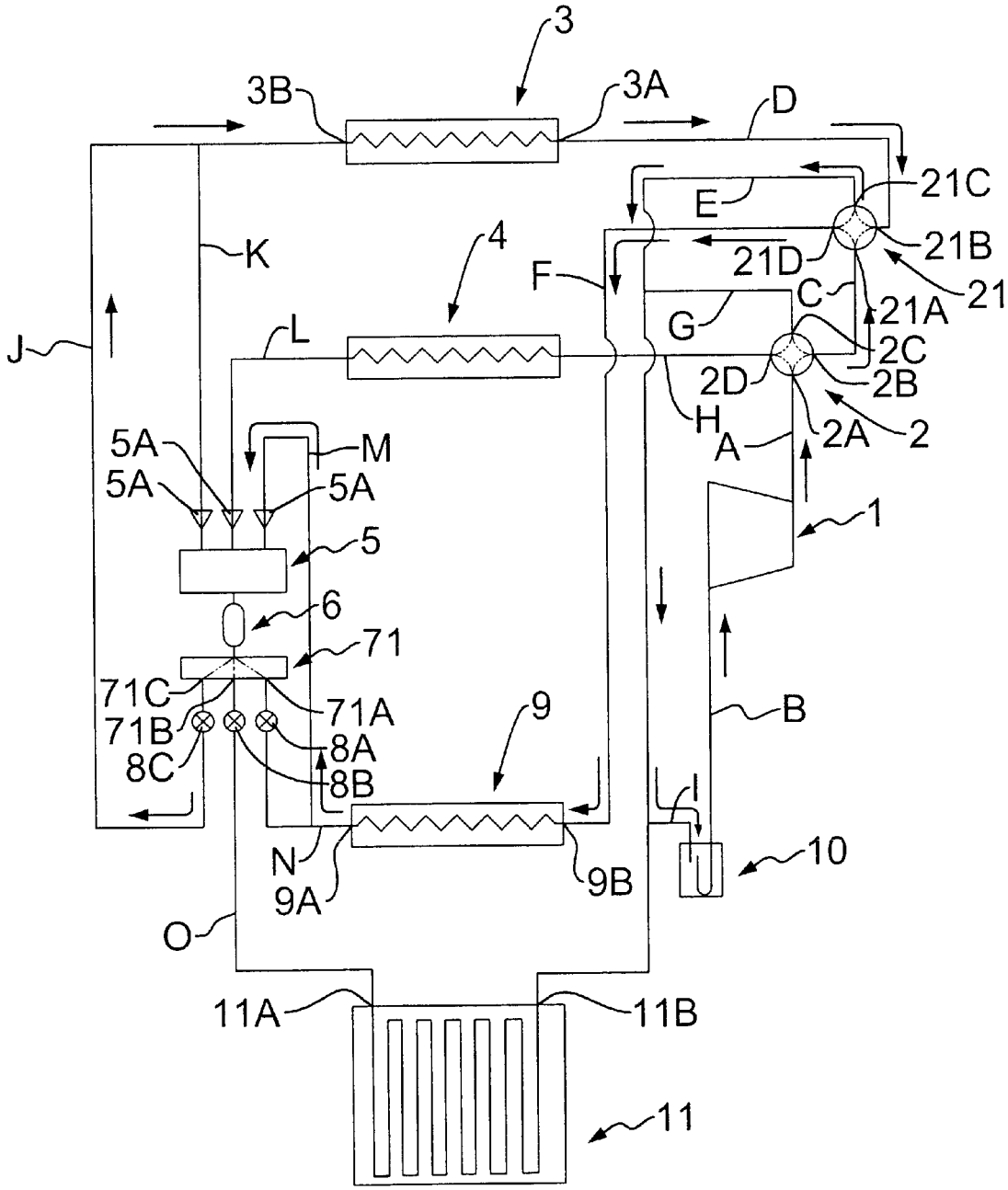
FIG. 14 is a schematic view of the embodiment in FIG. 8 operated in the sixth mode.

6. Alternative hot mode:

Referring to FIG. 14, the first four-way valve (2) is in a status of the first end (2A) in communication with the second end (2B), and the third end (2C) in communication with the fourth end (2D); the second four-way valve (21) is in a status of the first end (21A) in communication with the fourth end (21D), and the second end (21B) in communication with the third end (21C); and the third outlet (71C) of the switching means (71) is open.

The gaseous refrigerant flowing from the liquid-gas separator (10) through the second pipe (B) is compressed by the compressor (1) and flows through the first pipe (A), the first four-way valve (2), the sixth pipe (F) into the third heat exchanger (9) for supplying hot air (or water).

Thereafter, the refrigerant flows through the thirteenth pipe (M), the liquid chamber (5), the dryer (6), the third outlet (71C) of the switching means (71), the third expanding member (8C), the tenth pipe (J), and into the first heat exchanger (3) to exchange heat with the external environment.

Thereafter, the refrigerant flows out from the first exchanger (3) and through the fourth pipe (D), the second four-way valve (21), the fifth pipe (E), the ninth pipe (I) into the gas-liquid separator (10) to separate gaseous refrigerant for the next cycle. By this means, the device can provide an alternative mode to supply hot air (or water).

Figure 15:
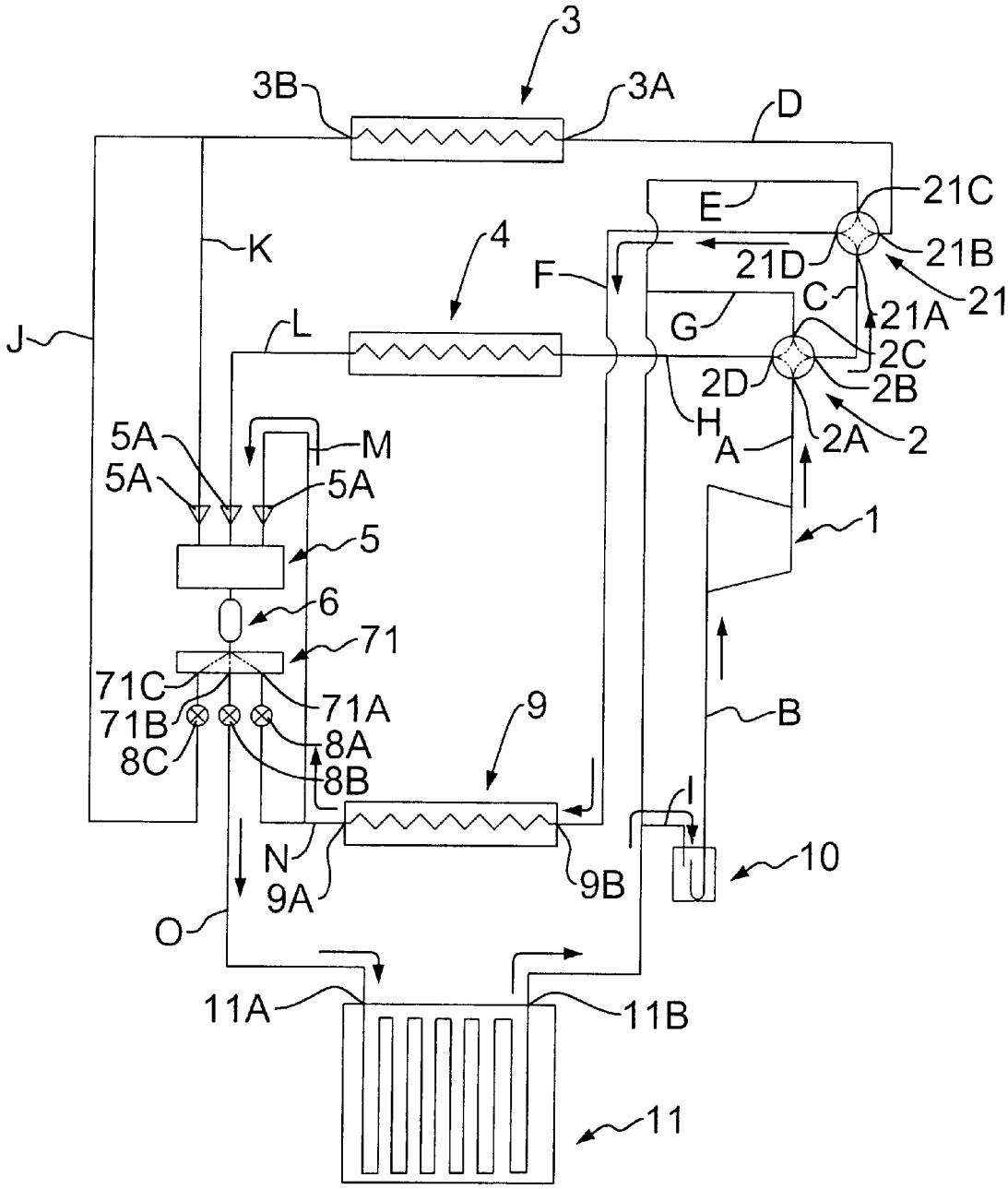
FIG. 15 is a schematic view of the embodiment in FIG. 8 operated in the seventh mode.

7. Alternative hot and ice-storing mode:

Referring to FIG. 15, the first four-way valve (2) is in a status of the first end (2A) in communication with the second end (2B), and the third end (2C) in communication with the fourth end (2D); the second four-way valve (21) is in a status of the first end (21A) in communication with the fourth end (21D), and the second end (21B) in communication with the third end (21C); and the second outlet (71B) of the switching means (71) is open.

The gaseous refrigerant flowing from the liquid-gas separator (10) through the second pipe (B) is compressed by the compressor (1) and flows through the first pipe (A), the first four-way valve (2), the sixth pipe (F) into the third heat exchanger (9) for supplying hot air (or water).

Thereafter, the refrigerant flows through the thirteenth pipe (M), the liquid chamber (5), the dryer (6), the second outlet (71B) of the switching means (71), the second expanding member (8B), the fifteenth pipe (J), and into the ice chamber (11) for maintaining a low temperature to enable storage of ice in the ice chamber (11).

Thereafter, the refrigerant flows out from the ice chamber (11) and through the fifth pipe (E), the ninth pipe (I) and into the gas-liquid separator (10) to separate gaseous refrigerant for the next cycle. By this means, the device also can provide hot air (or water) and be used for storing ice.

Furthermore, the device can be provided with temperature detectors (not shown or numbered) installed in the heat exchangers (3, 4, 9) and the ice chamber (1), which cooperate with a control circuit to automatically power on/off the device when the temperatures reach predetermine values.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A refrigerating and heating device comprising:

a compressor (1) having a first pipe (A) at an output end and a second pipe (B) at an input end;

a four-way valve (2) with a first end (2A), a second end (2B), a third end (2C) and a fourth end (2D), the first end (2A) of the four-way valve (2) connected with the compressor (1) by the first pipe (A);

a first heat exchanger (3) having a first input/output end (3A) connected with the second end (2B) of the four-way valve (2) by a third pipe (C), and a second input/output end (3B);

a fourth pipe (D) connected between the third end (2C) of the four-way valve (2) and the second pipe (B);

a second heat exchanger (4) having an input end connected with the fourth end (2D) of the four-way valve (2) by a fifth pipe (E);

a switching means (7) connected with an output end of the second heat exchanger (4) by a sixth pipe (F), the switching means (7) having a first outlet (7A) connected with an input end of a third heat exchanger (9) by a seventh pipe (G), and a second outlet (7B) connected with the second input/output end (3B) of the first heat exchanger (3) by an eighth pipe (H);

the third heat exchanger (9) having an output end connected with the second pipe (B) by a ninth pipe (I); and a tenth pipe (J) connected between the eighth pipe (H) and the switching means (7).

2. The refrigerating and heating device as claimed in claim 1 further comprising a gas-liquid separator (10) having an input end connected with the fourth pipe (D) and the ninth pipe (I), and an output end connected with the second pipe (B).

3. The refrigerating and heating device as claimed in claim 1 further comprising an ice chamber (11) having an input end connected with a third outlet (7C) of the switching means (7') by an eleventh pipe (K), and an output end connected with the second pipe (B) by a twelfth pipe (L).

4. The refrigerating and heating device as claimed in claim 2 further comprising an ice chamber ( 11) having an input end connected with a third outlet (7C) of the switching means (7') by an eleventh pipe (K), and an output end connected with the input end of the gas-liquid separator (10) by a twelfth pipe (L).

5. The refrigerating and heating device as claimed in claim 1 further comprising a liquid chamber (5) between the sixth pipe (F) and the tenth pipe (J) and the switching means (7).

6. The refrigerating and heating device as claimed in claim 5 further comprising a dryer (6) between the liquid chamber (5) and the switching means (7).

7. The refrigerating and heating device as claimed in claim 2 further comprising a liquid chamber (5) between the sixth pipe (F) and the tenth pipe (J) and the switching means (7).

8. The refrigerating and heating device as claimed in claim 7 further comprising a dryer (6) between the liquid chamber (5) and the switching means (7).

9. The refrigerating and heating device as claimed in claim 3 further comprising a liquid chamber (5) between the sixth pipe (F) and the tenth pipe (J) and the switching means (7).

10. The refrigerating and heating device as claimed in claim 9 further comprising a dryer (6) between the liquid chamber (5) and the switching means (7).

11. The refrigerating and heating device as claimed in claim 4 further comprising a liquid chamber (5) between the sixth pipe (F) and the tenth pipe (J) and the switching means (7).

12. The refrigerating and heating device as claimed in claim 11 further comprising a dryer (6) between the liquid chamber (5) and the switching means (7).

13. The refrigerating and heating device as claimed in claim 1 further comprising two expanding members (8) respectively provided in the seventh pipe (G) and the eighth pipe (H).

14. The refrigerating and heating device as claimed in claim 2 further comprising two expanding members (8) respectively provided in the seventh pipe (G) and the eighth pipe (H).

15. The refrigerating and heating device as claimed in claim 3 further comprising three expanding members (8) respectively provided in the seventh pipe (G), the eighth pipe (H), and the eleventh pipe (K).

16. The refrigerating and heating device as claimed in claim 4 further comprising three expanding members (8) respectively provided in the seventh pipe (G), the eighth pipe (H), and the eleventh pipe (K).

17. The refrigerating and heating device as claimed in claim 1 further comprising a check valve (5A) provided in the sixth pipe (6) for preventing refrigerant from flowing back from the switching means (7).

18. The refrigerating and heating device as claimed in claim 1 further comprising a check valve (5A) provided in the tenth pipe (J) for preventing refrigerant from flowing back from the switching means (7).

19. The refrigerating and heating device as claimed in claim 1 further comprising a check valve provided in the fifth pipe (6) for preventing refrigerant from flowing back from the second heat exchanger (4).

20. A refrigerating and heating device comprising:

a compressor (1) having a first pipe (A) at an output end and a second pipe (B) at an input end;

a first four-way valve (2) with a first end (2A), a second end (2B), a third end (2C), and a fourth end (2D), the first end (2A) of the first four-way valve (2) connected with the compressor (1) by the first pipe (A);

a second four-way valve (21) with a first end (21A), a second end (1B), a third end (21C) and a fourth end (21D), the first end (21A) of the second four-way valve (21) connected with the second end (2B) of the first four-way valve (2) by a third pipe (C);

a first heat exchanger (3) having a first input/output end (3A) connected with the second end (21B) of the second four-way valve (21) by a fourth pipe (D), and a second input/output end (3B);

a fifth pipe (E) connected between the third end (21C) of the second four-way valve (21) and the second pipe (B);

the third end (2C) of the first four-way valve (2) connected with the fifth pipe (E) by a seventh pipe (G);

a second heat exchanger (4) having an input end connected with the fourth end (2D) of the four-way valve (2) by an eighth pipe (H);

a switching means (71) connected with an output end of the second heat exchanger (4) by a twelfth pipe (L), the switching means (71) having a first outlet (71A) connected with a first input/output end (9A) of a third heat exchanger (9) by a fourteenth pipe (N), a second outlet (71B) connected with an input end (11A) of an ice chamber (11) by a fifteenth pipe (O), a third outlet (71C) connected with the second input/output end (3B) of the first heat exchanger (3) by a tenth pipe (J);

the ice chamber (11) having an output end (11B) connected with the second pipe (B) by a ninth pipe (I);

the third heat exchanger (9) having a second input/output end (9B) connected with the fourth end (21D) of the second four-way valve (21) by a sixth pipe (F);

an eleventh pipe (K) connected between the tenth pipe (J) and the switching means (71); and a thirteenth pipe (M) connected between the fourteenth pipe (14) and the switching means (71).

21. The refrigerating and heating device as claimed in claim 20 further comprising a gas-liquid separator (10) having an input end connected with the ninth pipe (I), and an output end connected with the second pipe (B).

22. The refrigerating and heating device as claimed in claim 20 further comprising a liquid chamber (5) connected between the eleventh, twelfth, thirteenth pipes (K, L, M) and the switching means (7).

23. The refrigerating and heating device as claimed in claim 22 further comprising three check valves (5A) respectively provided in the eleventh, twelfth, thirteenth pipes (K, L, M) for preventing refrigerant from flowing back from the switching means (71).

24. The refrigerating and heating device as claimed in claim 22 further comprising a dryer (6) connected between the liquid chamber (5) and the switching means (7).

25. The refrigerating and heating device as claimed in claim 21 further comprising a liquid chamber (5) connected between the eleventh, twelfth, thirteenth pipes (K, L, M) and the switching means (7).

26. The refrigerating and heating device as claimed in claim 25 further comprising three check valves (5A) respectively provided in the eleventh, twelfth, thirteenth pipes (K, L, M) for preventing refrigerant from flowing back from the switching means (71).

27. The refrigerating and heating device as claimed in claim 25 further comprising a dryer (6) connected between the liquid chamber (5) and the switching means (7).

28. The refrigerating and heating device as claimed in claim 20 further comprising a check valve provided in the eighth pipe (H) for preventing refrigerant from flowing back from the second heat exchanger (4).

29. The refrigerating and heating device as claimed in claim 21 further comprising three expanding members (8A, 8B, 8C) respectively provided in the tenth, fourteenth, fifteenth pipes (J, N, O).

* * * * *